US008132618B2

(12) United States Patent
Blaquiere

(10) Patent No.: US 8,132,618 B2
(45) Date of Patent: Mar. 13, 2012

(54) SYSTEMS FOR RETARDING ROD STRING BACKSPIN

(75) Inventor: Denis J. Blaquiere, Lloydminster (CA)

(73) Assignee: National Oilwell Varco, L.P., Houston, TX (US)

( * ) Notice: Subject to any disclaimer, the term of this patent is extended or adjusted under 35 U.S.C. 154(b) by 1222 days.

(21) Appl. No.: 11/851,637

(22) Filed: Sep. 7, 2007

(65) Prior Publication Data

US 2008/0060819 A1 Mar. 13, 2008

Related U.S. Application Data

(60) Provisional application No. 60/843,268, filed on Sep. 8, 2006.

(51) Int. Cl.
*E21B 19/02* (2006.01)

(52) U.S. Cl. ..... 166/85.1; 166/68.5; 166/77.51; 166/377; 188/296; 417/360

(58) Field of Classification Search ..... 166/105, 166/68.5, 77.51, 77.52, 85.1, 377; 188/296; 417/214, 360; 418/48; 294/82.15, 102.2
See application file for complete search history.

(56) References Cited

U.S. PATENT DOCUMENTS 1,891,832 A * 12/1932 Parks ..... 166/77.52
1,909,601 A * 5/1933 Young et al. ..... 188/67
5,038,871 A 8/1991 Dinsdale
5,749,416 A 5/1998 Belcher
6,079,489 A 6/2000 Hult et al.
6,152,231 A * 11/2000 Grenke ..... 166/369
6,253,844 B1 * 7/2001 Walker ..... 166/77.51
7,806,665 B2 * 10/2010 Mello et al. ..... 417/214

FOREIGN PATENT DOCUMENTS

GB 2299849 A * 10/1996

OTHER PUBLICATIONS

International Search Report and Written Opinion for Appl. No. PCT/US07/77894; dated Apr. 1, 2008; (8 p.).
Canadian Application No. 2,662,055 Office Action dated Dec. 15, 2010.

* cited by examiner

*Primary Examiner* — Shane Bomar
*Assistant Examiner* — Robert E Fuller
(74) *Attorney, Agent, or Firm* — Conley Rose, P.C.

(57) ABSTRACT

A system comprises a progressive cavity pump including a helical rotor disposed within a mating stator. In addition, the system comprises a rod string having a longitudinal axis, a first end, and a second end coupled to the rotor. Further, the system comprises a rotation retarding device coupled to the first end of the rod string, wherein the rotation retarding device retards the rotation of the rod string relative to the stator. Still further, the system comprises a lifting device coupled to the rotation retarding device, wherein the lifting device is operable to apply an axial lifting force to the rotor.

21 Claims, 9 Drawing Sheets

SYSTEMS FOR RETARDING ROD STRING BACKSPIN

CROSS-REFERENCE TO RELATED APPLICATIONS

This application claims benefit of U.S. provisional application Ser. No. 60/843,268 filed Sep. 8, 2006, and entitled "Flush Brake Systems and Methods," which is hereby incorporated herein by reference in its entirety for all purposes.

STATEMENT REGARDING FEDERALLY SPONSORED RESEARCH OR DEVELOPMENT

Not applicable.

BACKGROUND

1. Field of the Invention

The invention relates generally to systems and methods for lifting the rotor of a downhole progressive cavity pump. More particularly, the invention relates to systems and methods for pulling the rotor of a downhole progressive cavity pump while retarding the backspin of the rod string coupled to the rotor.

2. Background of the Invention

Progressive cavity pumps, also known as "Moineau" pumps, pump a fluid via a sequence of small, discrete, sealed cavities that progress from one end of the pump to the other. Progressive cavity pumps are commonly used in oil and gas development operations. For instance, progressive cavity pumps may be used to produce a low pressure oil well or to raise water from a borehole.

As shown in FIGS. 1 and 2, a conventional progressive cavity pump 10 includes a helical-shaped rotor 30, typically made of steel that may be chrome-plated or coated for wear and corrosion resistance, disposed within a mating stator 20, typically a heat-treated steel tube 25 lined with a helical-shaped elastomeric insert 21. Rotor 30 defines a set of rotor lobes 37 that intermesh and periodically seal with a set of stator lobes 27 defined by insert 21. As best shown in FIG. 2, rotor 30 typically has one fewer lobe 37 than stator 20. When rotor 30 and stator 20 are assembled, a series of cavities 40 are formed between the outer surface 33 of rotor 30 and the inner surface 23 of stator 20. Each cavity 40 is sealed from adjacent cavities 40 by seals formed along the contact lines between rotor 30 and stator 20. As best shown in FIG. 2, the central axis 38 of rotor 30 is offset from the central axis 28 of stator 20 by a fixed value known as the "eccentricity" of the rotor-stator assembly.

Stator 20 is traditionally suspended on a string of tubing which hangs inside the well casing, and rotor 30 is typically disposed on the downhole end of a rod string (not shown). At the surface, a drivehead or motor transmits rotational motion to rotor 30 through the rod string. Depending on the length of the rod string, the upper end of the rod string coupled to the drivehead may rotate ten to 20 turns before downhole rotor 30 begins to rotate, resulting in significant torsional energy build-up in the rod string. As rotor 30 is rotated relative to stator 20, fluid contained in cavities 40 between rotor 30 and stator 20 is pumped toward the surface via the sequence of discrete cavities 40 that move through pump 10. As this rotation and movement of cavities 40 repeats in a continuous manner, the fluid is transferred progressively along the length of pump 10. The volumetric flow rate of fluid pumped by pump 10 is generally proportional to the rotational speed of rotor 30 within stator 20. In addition, the fluid pumped in this manner experiences relatively low levels of shearing, which may be important for transferring viscous or shear sensitive fluids.

On occasion, the rotor of a progressive cavity pump (e.g., rotor 30) may need to be pulled or lifted from its mating stator (e.g., stator 20) for maintenance, repairs, or to free a rotor that gets stuck or jammed within the stator. For instance, a rotor pumping a fluid with a high water and sand content may get stuck if the pump does not provide sufficient velocity to carry the sand to the surface. In such a well, the sand may settle out on top of the pump. The sand may continue to settle out on top of the pump until it creates a sufficient flow restriction to overcome the power of the surface drivehead. As another example, a rotor may become stuck in the stator because of an incompatible fluid. Some fluids passing through a progressive cavity pump may interact with the stator (e.g., elastomeric stator) and cause the stator to swell or contract. If the stator swells sufficiently, it may over-engage the rotor resulting in frictional force sufficient to overcome the power of the drivehead.

When the rotor becomes stuck, the rotor can no longer rotate within the stator. As a result, the downhole progressive cavity pump is unable to pump fluid, and further, the drivehead at the surface may stall. In such cases, it may be necessary to pull the rotor from the stator. However, when the upper end of the rod string is disengaged from the drivehead to pull the rotor, there is a tendency for the rotor and rod string to "backspin." The tendency to backspin results from the combination of two factors. First, the rod string functions like a powerful torsion spring when it is decoupled from the drivehead—the build-up of torsional energy in the rod string resulting from the twisting referred to above tends to rotate the rod string backwards. Second, when the rotor is pulled from the stator, the column of fluid (i.e., fluid head) above the progressive cavity pump will tend to flow back down under the force of gravity past the pulled rotor and through the stator. As the fluid flows past the rotor it tends to cause the helical-shaped rotor to function like a progressive cavity motor and rotate backwards. In some cases, the backspin of the rod string experienced when the rotor is pulled may exceed 1000 RPM.

The acceleration and rotational velocity of a back-spinning rod string presents a variety of potential safety hazards at the surface. For instance, the upper end of the rod string, also referred to as a "polish rod", may bend over while back-spinning, potentially impacting nearby persons or objects. In addition, a bent polish rod may send debris flying across the worksite. Further, extreme vibrations generated by the violent back-spinning may cause weaken or damage the support structure surrounding the rod string at the surface. Moreover, in some cases, contact between metal parts with high relative rotational velocities may result in sparks that could ignite combustible gases and hydrocarbon liquids at the surface.

Accordingly, there remains a need in the art for devices, methods, and systems to more safely lift a rotor from a downhole progressive cavity pump. Such devices, methods, and systems would be particularly well received if capable of retarding the backspin of the rod string employed to pull the rotor.

BRIEF SUMMARY OF SOME OF THE PREFERRED EMBODIMENTS

In accordance with at least one embodiment of the invention, a system comprises a progressive cavity pump including a helical rotor disposed within a mating stator. In addition, the system comprises a rod string having a longitudinal axis, a first end, and a second end coupled to the rotor. Further, the system comprises a rotation retarding device coupled to the first end of the rod string, wherein the rotation retarding device retards the rotation of the rod string relative to the stator. Moreover, the system comprises a lifting device coupled to the rotation retarding device, wherein the lifting device is operable to apply an axial lifting force to the rotor.

In accordance with other embodiments of the invention, a method comprises providing a progressive cavity pump comprising a helical rotor disposed within a mating stator, wherein the rotor is coupled to a first end of a rod string having a longitudinal axis. In addition, the method comprises applying an axial lifting force to the rod string. Further, the method comprises lifting the rotor from the stator. Still further, the method comprises retarding the rotation of the rod string and the rotor relative to the stator.

In accordance with still other embodiments of the invention, a system comprises a housing having an upper end, a lower end, and a brake cavity. In addition, the system comprises a shaft having a longitudinal axis at least partially disposed in the brake cavity, wherein the shaft is rotatably coupled to the housing and is operable to rotate about its axis relative to the housing. Further, the system comprises a brake disposed in the brake cavity, wherein the brake retards the rotation of the shaft relative to the housing. Still further, the system comprises a rod string having a first end coupled to the shaft and a second end. Moreover, the system comprises a progressive cavity pump including a helical rotor disposed within a mating stator, the rotor coupled to the second end of the rod string. Furthermore, the system comprises a lifting device coupled to the housing, wherein the lifting device is operable to apply an axial lifting force to the housing.

Thus, embodiments described herein comprise a combination of features and advantages intended to address various shortcomings associated with certain prior devices. The various characteristics described above, as well as other features, will be readily apparent to those skilled in the art upon reading the following detailed description of the preferred embodiments, and by referring to the accompanying drawings.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
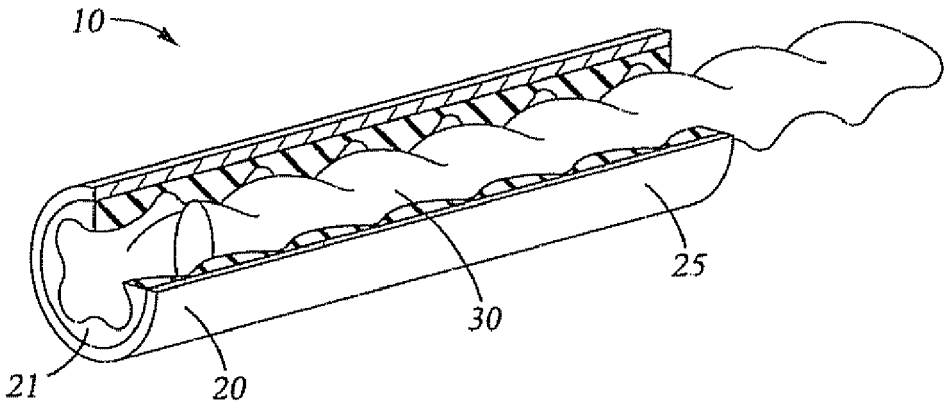
Fig. 1 (PRIOR ART)
FIG. 1 is a perspective, partial cut-away view of a conventional progressive cavity pump.

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection, or through an indirect connection via other devices and connections.

Figure 2:
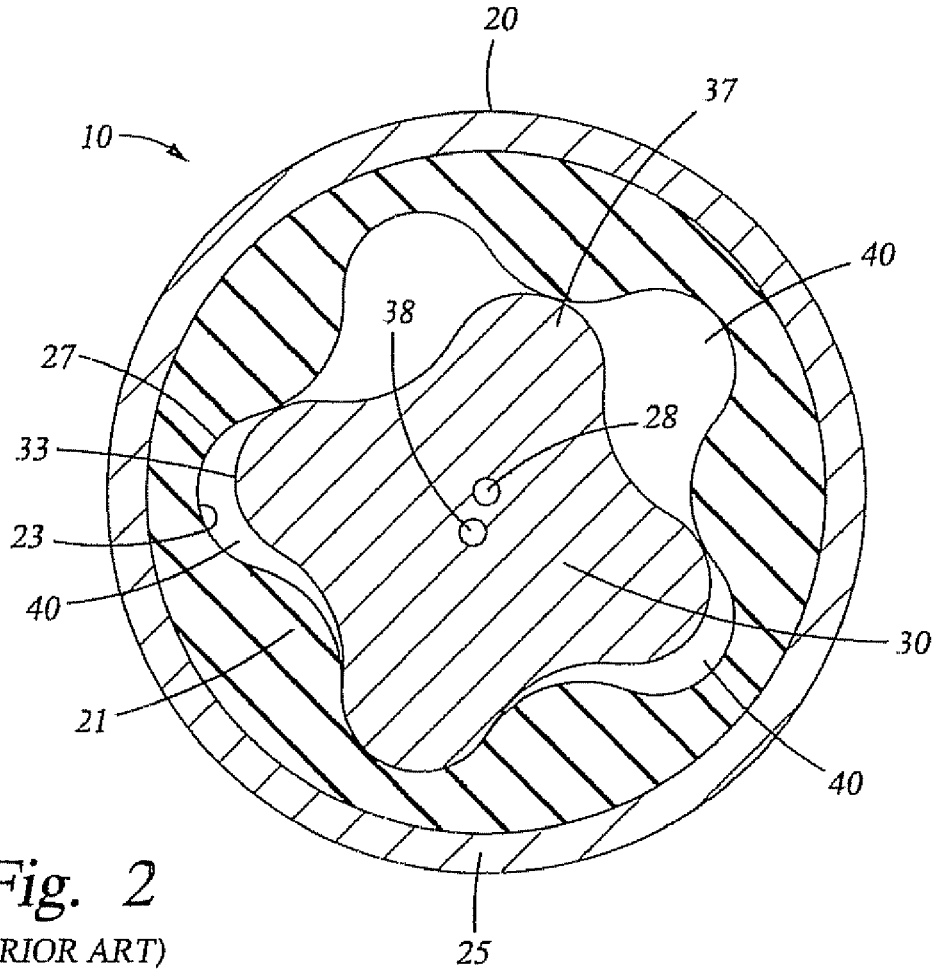
Fig. 2 (PRIOR ART)
FIG. 2 is an end of the progressive cavity pump of FIG. 1.

For purposes of this discussion, x- and y-axes are shown in FIGS. 1 and 2, and consistently maintained throughout. The x-axis generally defines radial positions and radial movement (i.e., perpendicular to a central axis). The y-axis generally defines axial positions and axial movement (i.e., along or parallel to a central axis). It is to be understood that the x-axis and y-axis are orthogonal.

Figure 3:
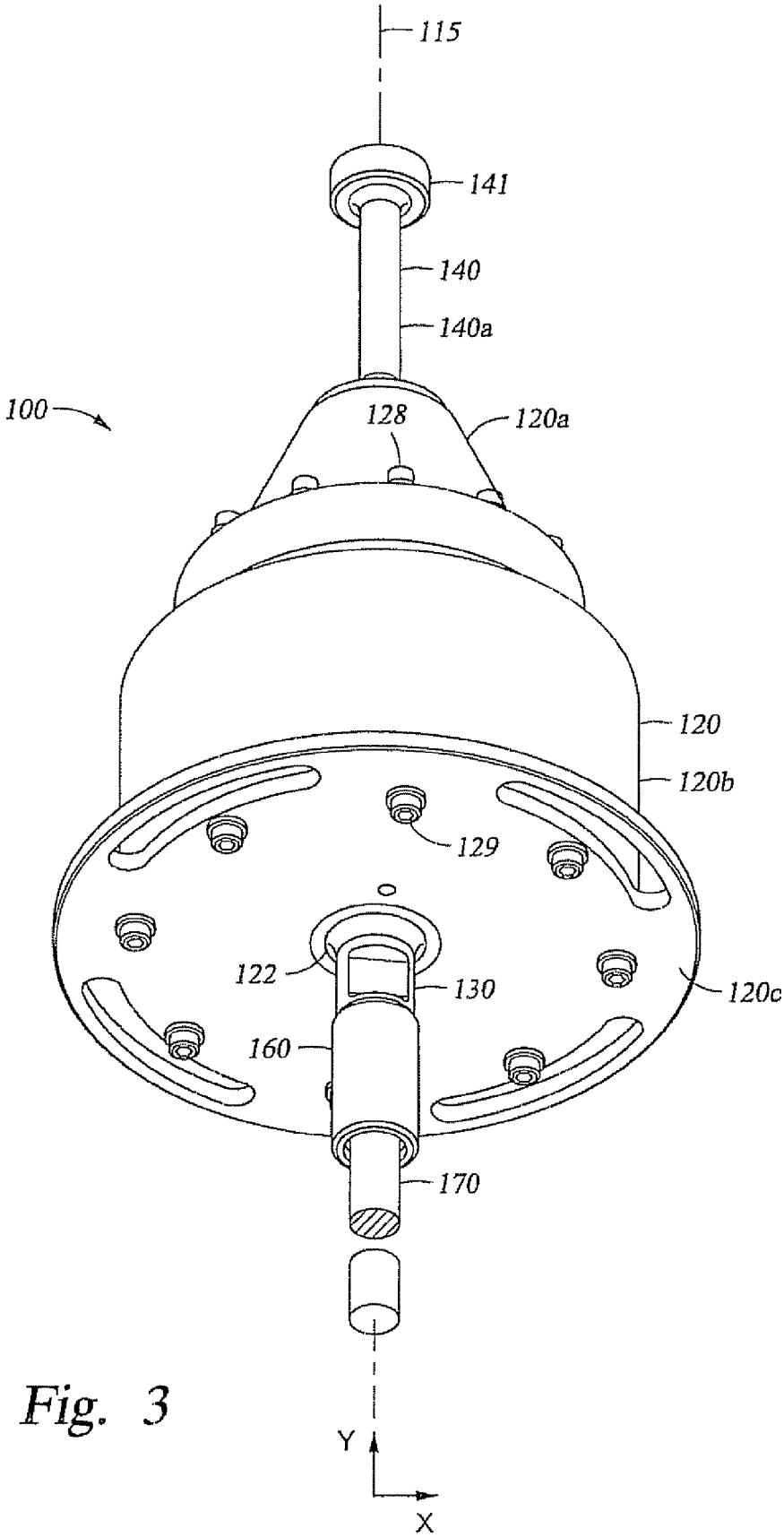
FIG. 3 is a perspective view of an embodiment of a rotation retarding device.
Figure 4:
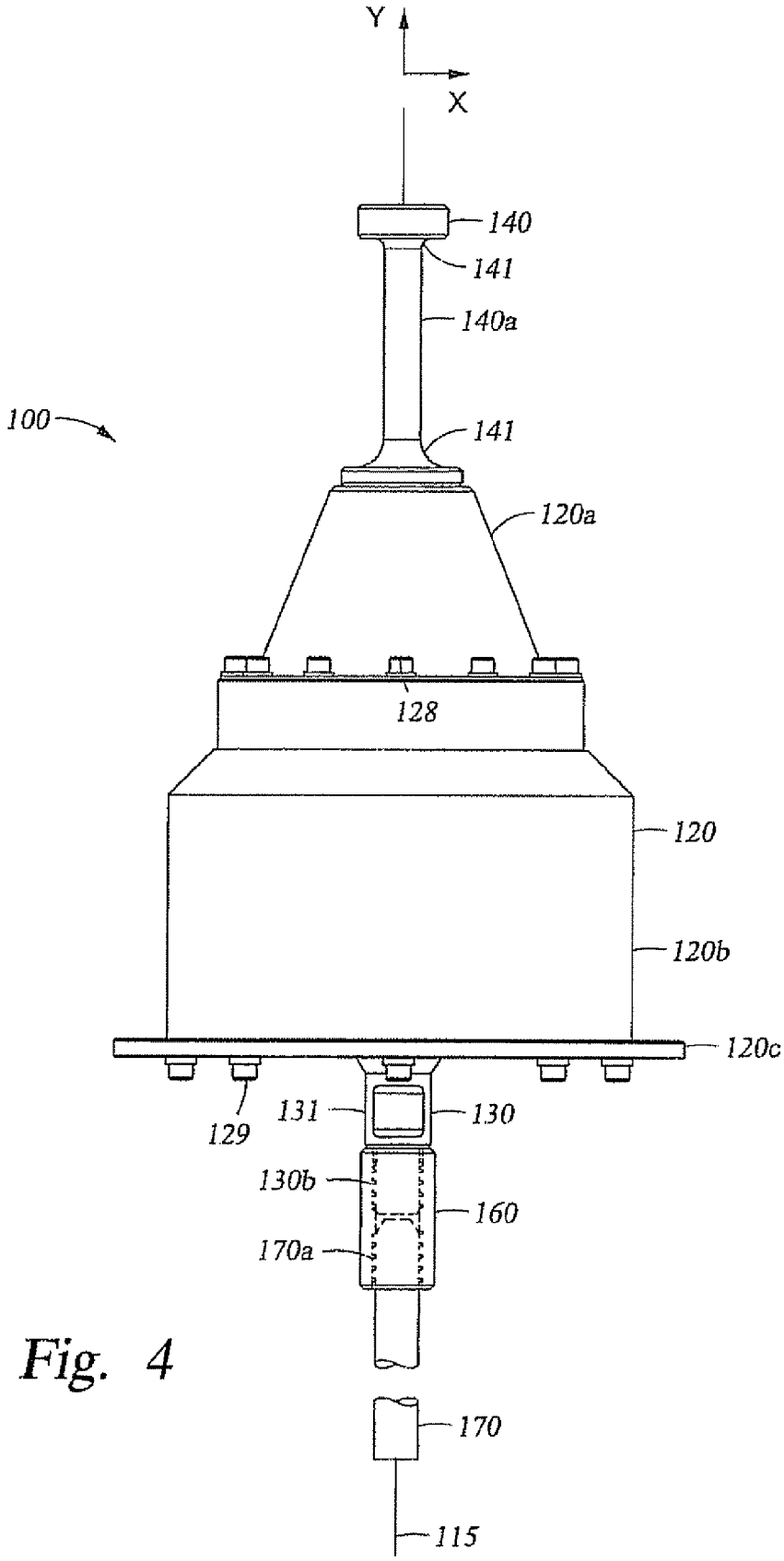
FIG. 4 is a front view of the rotation retarding device of FIG. 3.
Figure 5:
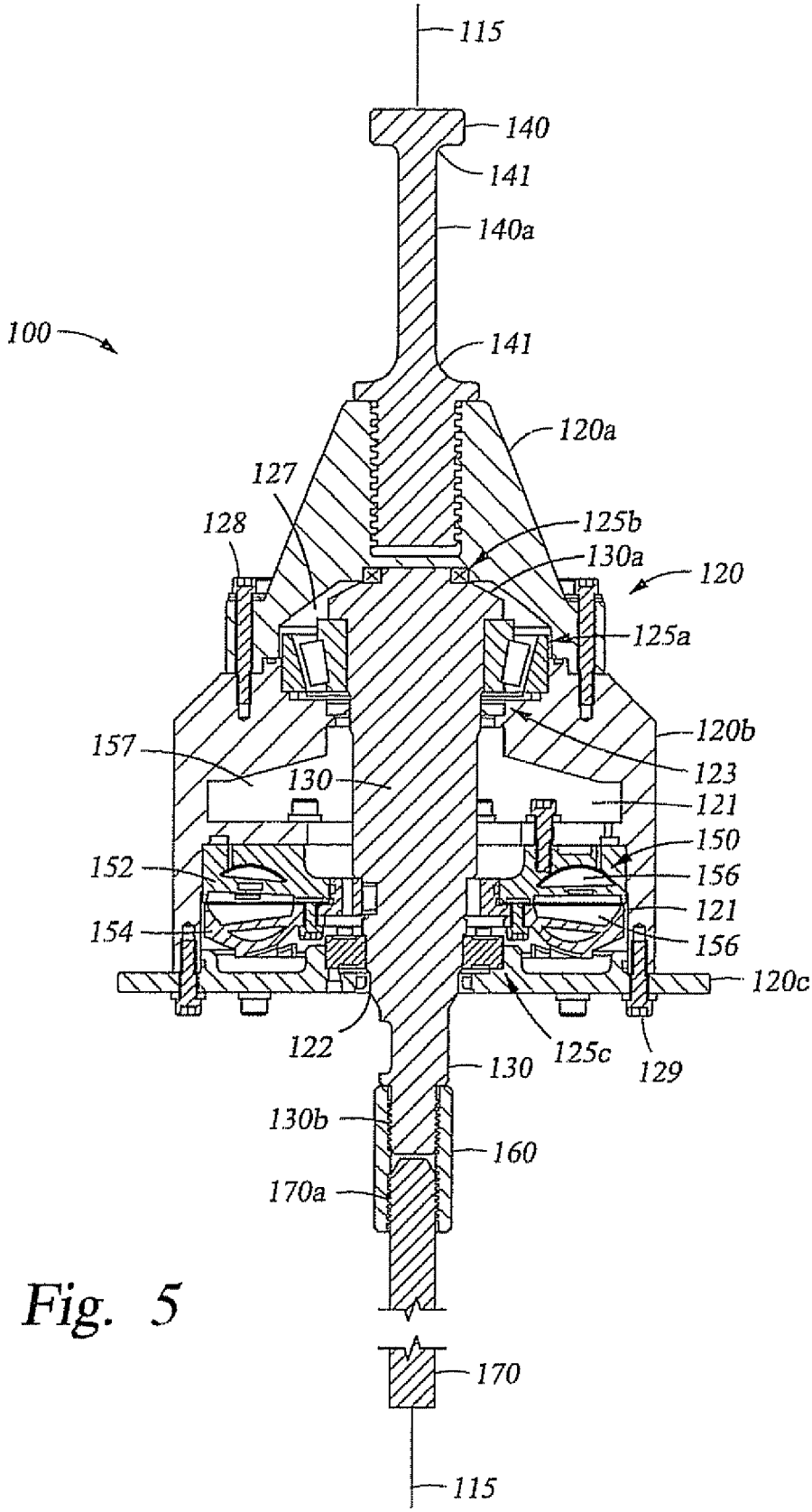
FIG. 5 is a cross-sectional view of the rotation retarding device of FIG. 3.

Referring now to FIGS. 3-5, an embodiment of a flush-by-brake or rotation retarding device 100 is shown. Flush-by-brake 100 includes a housing 120, a shaft 130, and a rotation retarder or brake 150. As will be explained in more detail below, flush-by-brake 100 is configured to simultaneously lift the rotor of a downhole progressive cavity pump and retard the backspin of the rod string coupled to the rotor.

In this embodiment, housing 120 comprises a top 120*a*, a cylindrical main body 120*b*, and a lower cap 120*c*. Top 120*a* is coupled to the upper end of body 120*b* by connection members 128, and includes a knob or handle 140 that extends axially from the upper end of top 120*a* generally opposite body 120*b*. Top 120*a* is releasably fixed to body 120*b* by connection members 128 such that top 120*a* does not move rotationally or translationally (radially or axially) relative to body 120*b*, but may be removed from body 120*b* as desired.

In this embodiment, handle 140 is a distinct component that is fixed to top 120*a* via mating threads. Thus, handle 140 does not move rotationally or translationally (radially or axially) relative to housing 120. Although handle 140 is shown in FIG. 5 as being fixed to housing 120 by mating threads, other suitable means may be employed to fix handle 140 to housing 120. Examples of other suitable means include, without limitation, bolts, welding, or combinations thereof. Further, in some embodiments, handle 140 may be integral with housing 120.

As best seen in FIG. 5, in this embodiment, handle 140 has an "I-shaped" cross-section including a reduced diameter grip portion 140*a* defining annular shoulders 141 disposed at either end of grip portion 140*a*. As will be explained in more detail below, this configuration allows an external device such as a rod elevator or hook to grasp grip portion 140*a* and apply axial and/or radial loads to housing 120.

Referring again to FIGS. 3-5, cap 120*c* is coupled to the lower end of body 120*b* by connection members 129, and includes a central through bore 122 through which shaft 130 passes. Cap 120*c* is releasably fixed to body 120*b* by connection members 129, such that cap 120*c* do not move rotationally or translationally (radially or axially) relative to body 120*b*, but may be removed from body 120*b* as desired. Although connection members 128, 129 are shown as bolts in this embodiment, in general, top 120*a* and lower cap 120*c* may be coupled to body 120*b* by any suitable means.

Referring specifically to FIG. 5, Housing 120 also includes an upper bearing cavity 127 defined by top 120*a* and body 120*b*, and a lower brake cavity 121 defined by body 120*b* and cap 120*c*. Top 120*a* and cap 120*c* are each preferably releasably coupled to body 120*b* such that cavities 121, 127 may be accessed for maintenance and/or repair of the components disposed therein.

Shaft 130 has a longitudinal axis 115 and is partially disposed within housing 120. In particular, shaft 130 has an upper end 130*a* disposed within bearing cavity 127, a lower end 130*b* distal housing 120, and extends through brake cavity 121 and bore 122 between ends 130*a, b*. In this embodiment, shaft 130 is coaxial with housing 120.

Shaft 130 is coupled to housing 120 with a pair of upper bearing assemblies 125*a, b* and a lower bearing assembly 125*c*. Upper bearing assembly 125*a* is disposed within bearing cavity 127 between shaft 130 and housing 120, the other upper bearing assembly 125*b* is disposed within bearing cavity 127 between upper end 130*b* and top 120*a*, and lower bearing assembly 125*c* is disposed within brake cavity 121 between shaft 130 and cap 120*c*. Bearing assemblies 125*a, b, c* support shaft 130 by maintaining the axial and radial position of shaft 130 relative to housing 120. In other words, bearing assemblies 125*a, b, c* restrict the axial and radial movement of shaft 130 relative to housing 120. However, bearing assemblies 125*a, b, c* permit shaft 130 to rotate about its axis 115, in either direction, relative to housing 120. In this embodiment, upper bearing assembly 125*a* comprises a tapered roller thrust bearing, upper bearing assembly 125*b* comprises a nylatron thrust bearing, and lower bearing assembly 125*c* comprises a radial cylindrical roller bearing. 125C However, in general, any suitable type of bearings may be employed to provide axial and radial support of shaft 130 while permitting rotation of shaft 130 about its axis 115. Examples of suitable bearings include without limitation journal bearings, thrust bearings, roller bearings, fluid bearings, magnetic bearings, or combinations thereof.

Bearing assemblies 125*a, b, c* are preferably lubricated to allow relatively smooth, free rotation of shaft 130. In this embodiment, bearing cavity 127 is filled with a lubricant (e.g., grease), thereby lubricating upper bearing assemblies 125*a, b*. Bearing cavity 127 is sealed from brake cavity 121 by a seal assembly 123 to restrict the loss of lubricant from bearing cavity 127. In this embodiment, seal assembly 123 comprises a lip seal, however, in general, bearing cavity 127 and upper bearing assemblies 125*a, b* may be sealed from brake cavity 121 by any suitable means such as an o-ring seal. As will be explained in more detail below, seal assembly 123 preferably restricts lubricant in bearing cavity 127 from entering brake cavity 121, but permits fluid in brake cavity 121 to enter bearing cavity 127 in the event of an excessive pressure build-up in brake cavity 121. In this embodiment, bearing cavity 127 is vented to the atmosphere via relief valve (not shown) to relieve an excessive pressure build-up in bearing cavity 127.

Referring still to FIG. 5, brake 150 is disposed within brake cavity 121 and is configured to retard the rotation of shaft 130 relative to housing 120. In this embodiment, brake 150 is a hydrodynamic brake including an annular stator 152 and an annular rotor 154. Stator 152 is disposed about shaft 130 and is fixed to body 120*b*, and rotor 154 is disposed about shaft 130 and fixed to shaft 130. Thus, stator 152 does not move rotationally or translationally (radially or axially) relative to housing 120, and rotor 154 does not move rotationally or translationally (radially or axially) relative to shaft 130. Thus, when shaft 130 rotates relative to housing 120, rotor 154 rotates therewith relative to stator 152.

Stator 152 and rotor 154 each include a plurality of vanes 156, each vane 156 being positioned at substantially the same radial distance from shaft 130. Stator 152 and rotor 154 are positioned axially adjacent one another such that vanes 156 of stator 152 are positioned opposite vanes 156 of rotor 154.

Referring still to FIG. 5, the spaces and voids surrounding brake 150 (e.g., spaces between rotor 154 and stator 152, spaces between vanes 156, etc.) are filled with a retarding fluid suitable for hydrodynamic braking applications (e.g., automatic transmission fluid). A retarding fluid reservoir 157 is formed in the upper portion of brake cavity 121. As will be explained in more detail below, the retarding fluid is circulated between brake 150 and retarding fluid reservoir 157 via a plurality of ports and passages (not shown) extending between reservoir 157 and brake 150. The retarding fluid surrounding brake 150 in the lower portion of brake cavity 121 also surrounds and lubricates lower bearing assembly 125*c*. In this sense, lower bearing assembly 125*c* may also be referred to herein as "bath lubricated".

Brake 150 retards the rotation of shaft 130 relative to housing 120 by transforming the kinetic energy of shaft 130 into thermal energy absorbed by the retarding fluid. In this embodiment, brake 150 is configured to retard the rotation of shaft 130 relative to housing 120. In particular, the rotation of rotor vanes 156 relative to stator vanes 156 through the retarding fluid generates fluid friction and associated forces that oppose the relative rotation of rotor 154, and hence oppose the rotation of shaft 130 (i.e., the forces generated by the fluid friction are transferred from rotor 154 to shaft 130). It should also be appreciated that the fluid friction also generates thermal energy (i.e., heat) that is absorbed by the retarding fluid. However, at least some of the thermal energy absorbed by the retarding fluid is carried away as the retarding fluid is recirculated between brake 150 and fluid reservoir 157. Without being limited by this or any particular theory, the increase in temperature of the retarding fluid will result in thermal expansion of the retarding fluid and associated pressure build-up within brake cavity 121. At a sufficient pressure, also referred to as a "critical pressure", the retarding fluid may overcome lip seal 123 and pass from brake cavity 121 into bearing cavity 127, thereby at least partially relieving pressure within brake cavity 121. As previously described, bearing cavity 127 may be vented to the atmosphere via a relief valve (not shown) to relieve any excessive pressure within bearing cavity 127. The thermal energy build-up and thermal expansion of the retarding fluid, the pressure in brake cavity 121 is In other embodiments, an external radiator or cooler may also be employed to cool the heated retarding fluid. In this manner, brake 150 provides a means to retard the rotational motion of shaft 130 relative to housing 120. The braking or retarding forces imposed on shaft 130 via rotor 154 are generally proportional to the rotational speed of rotor 154 relative to stator 152. Depending on the application, the retarding forces provided by brake 150 may be adjusted by modifying the geometry of housing 120 and/or brake 150 (e.g., adjusting the number, size, and orientation of vanes 156), by selecting a different retarding fluid having different properties (e.g., different viscosity), or combinations thereof. The maximum retarding force generated by brake 150 is preferably in excess of about 2000 ft/lbs.

Although brake 150 has been described as a hydrodynamic brake, it is to be understood that brake 150 may be any suitable brake or device capable of retarding the rotation of shaft 130 relative to housing 120. Examples of other suitable brakes include, without limitation, friction brakes, drum-type brakes, disc-type brakes, and the like.

Referring again to FIGS. 3-5, a cylindrical sleeve or connector 160 releasably couples shaft 130 to an upper or surface end 170*a* of a rod string 170. Rod string 170 is coupled to shaft 130 such that the longitudinal axis of rod string 170 is aligned with the longitudinal axis 115 of shaft 130. The lower end of rod string 170 (not shown in FIGS. 3-5) is coupled to the rotor of a downhole progressive cavity pump. In particular, connector 160 fixes lower end 130*b* of shaft 130 end-to-end with the upper end 170*a* of rod string 170, such that shaft 130 does not move rotationally or translationally (radially or axially) relative to rod string 170. In this embodiment, connector 160 is coupled to shaft 130 and rod string 170 via mating threads. A clamp, pin, or other mechanical device may be employed in conjunction with connector 160 to restrict disengagement of such mating threads. Thus, once shaft 130 is sufficiently coupled to rod string 170 via connector 160, shaft 130 will rotate along with rod string 170. Although rotation of shaft 130 and rod string 170 relative to housing 120 is permitted, the rotation is at least partially retarded by brake 150. The retarding forces applied to shaft 130 via rotor 154 are transferred to rod string 170 by connector 160, thereby retarding the rotation of rod string 170.

It should be appreciated that as shaft 130 begins to rotate relative to housing 120, housing 120 may have a tendency to rotate along with shaft 130. Specifically, the retarding forces acting on stator 120 and frictional forces arising at bearings 125*a, b*, may induce the rotation of housing 120 to rotate in the same direction as shaft 130. Rotation of housing 120 along with shaft 130 reduces the rotational speed of rotor 154 relative to stator 152, thereby reducing the retarding forces acting on shaft 130. Thus, to enhance the retarding forces applied to shaft 130 and rod string 170, housing 120 and stator 152 are preferably restricted from rotating along with shaft 130 and rotor 154. Therefore, as will be explained in more detail below, in some embodiment, an anchor may be coupled to housing 120 and attached to a fixed object proximal flush-by-brake 100 to restrict the rotation of housing 120.

Figure 6:
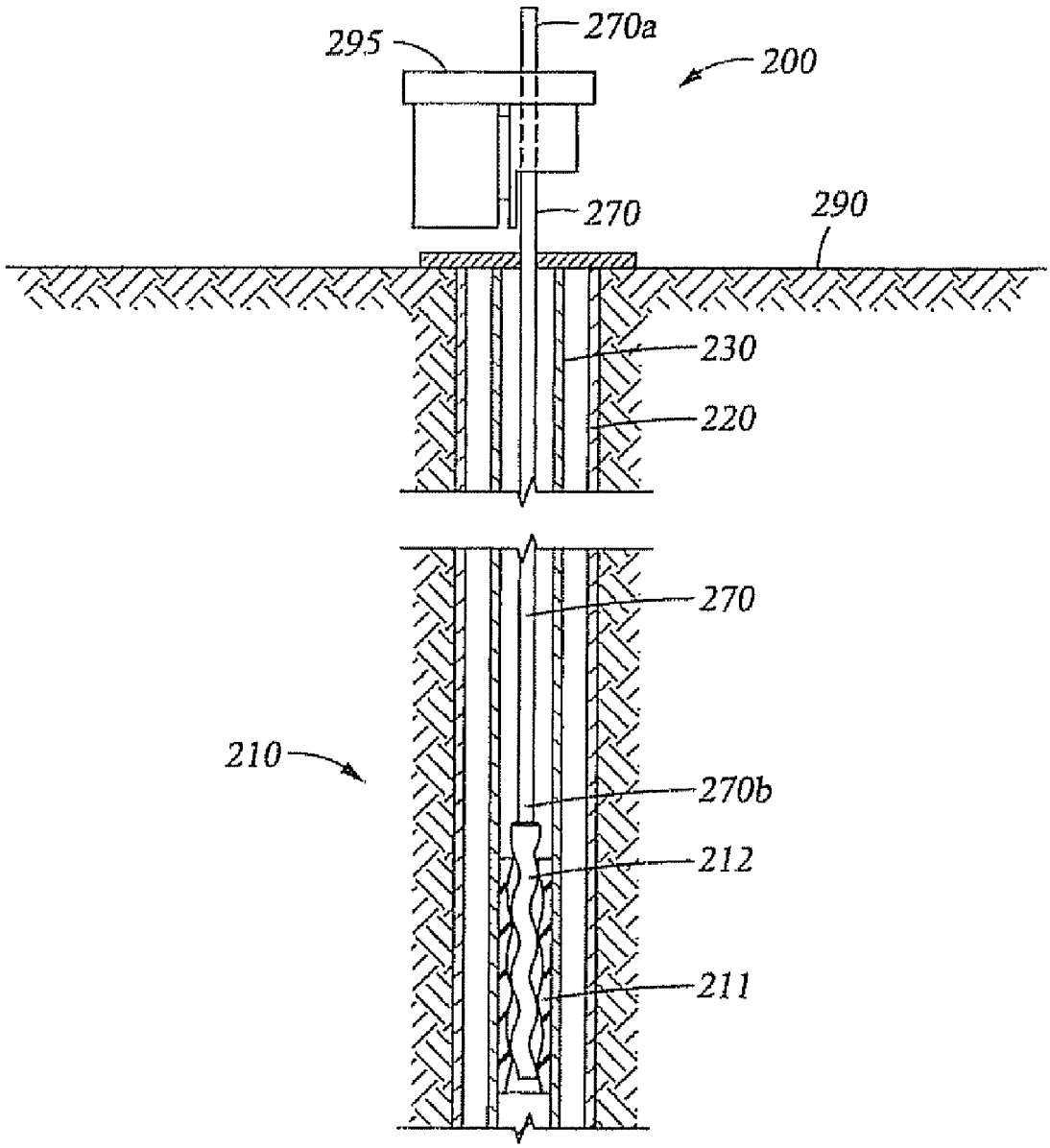
FIG. 6 is a partial cross-sectional view of an embodiment of a progressive cavity pump system.

Referring now to FIG. 6, a progressive cavity pump system 200 used to pump a downhole fluid to the surface is shown. Pump system 200 comprises a surface drivehead 295, rod string 170 previously described, and a downhole progressive cavity pump 210 including a helical rotor 212 disposed within a mating stator 211. Drivehead 295 drives the rotation of rod string 170 which in turn rotates rotor 212 and powers pump 210.

Progressive cavity pump 210 is disposed in a string of production tubing 230 that extends into a well through a casing 220. Stator 211 that is secured downhole to tubing 230. In general, progressive cavity pump 210 may be any conventional progressive cavity pump known in the art.

Upper end 170*a* of rod string 170, also referred to as a "polish rod" extends to the surface 290, while lower or downhole end 170*b* is coupled to rotor 212. Drivehead 295 is mechanically coupled (e.g., by mating gears) to rod string 170 proximal upper end 170*a* and applies rotational forces to rod string 170 to rotate rotor 212.

During normal operation of progressive cavity pump 210, rotor 212 is positioned within stator 211 and is rotated relative to stator 211 by rod string 170 to pump fluid through tubing 230 to the surface 290. As previously discussed, on occasion, rotor 212 may need to be pulled from stator 211. For instance, rotor 212 may become stuck within stator 211. However, as previously described, when rotor 212 is pulled from stator 211, there will be a tendency for rotor 212 and rod string 170 to backspin due to the built up torsional energy in rod string 170, and from the flow of fluid head down through tubing 230 past the pulled rotor 212 under the force of gravity. The backspin of rod string 170 and rotor 212 may exhibit rapid acceleration and high rotational velocities, presenting potential safety hazards to individuals and equipment near upper end 170*a* of rod string 170. However, embodiments of flush-by-brake 100 previously described with reference to FIGS. 3-5 may be employed pull rotor 212 while retarding the backspin of rod string 170, thereby offering the potential to improve operational safety.

Figure 7:
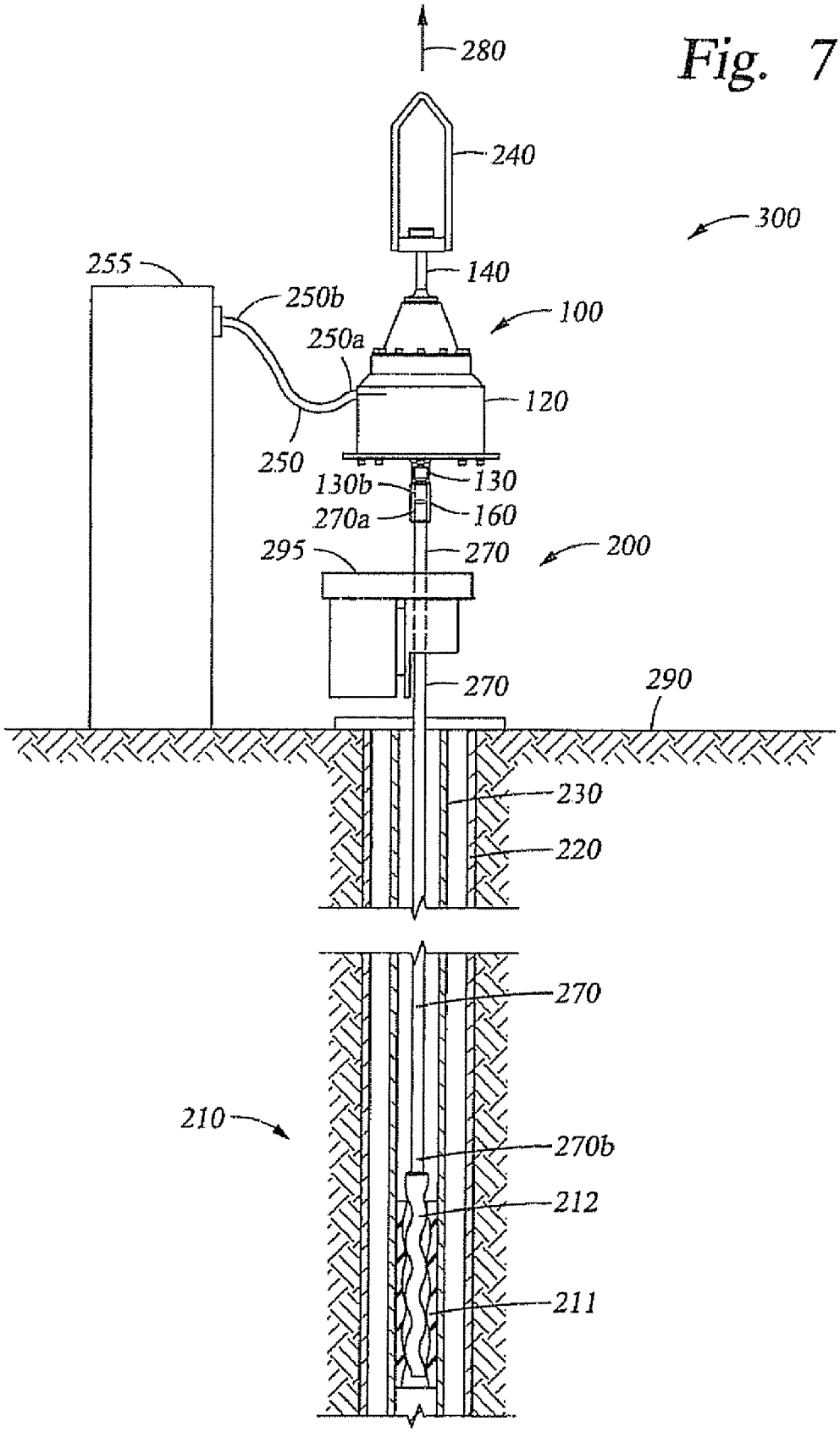
FIGS. 7 and 8 are selected partial cross-sectional views of an embodiment of a system for pulling the rotor of FIG. 6 while retarding the backspin of the rod string of FIG. 6.
Figure 8:
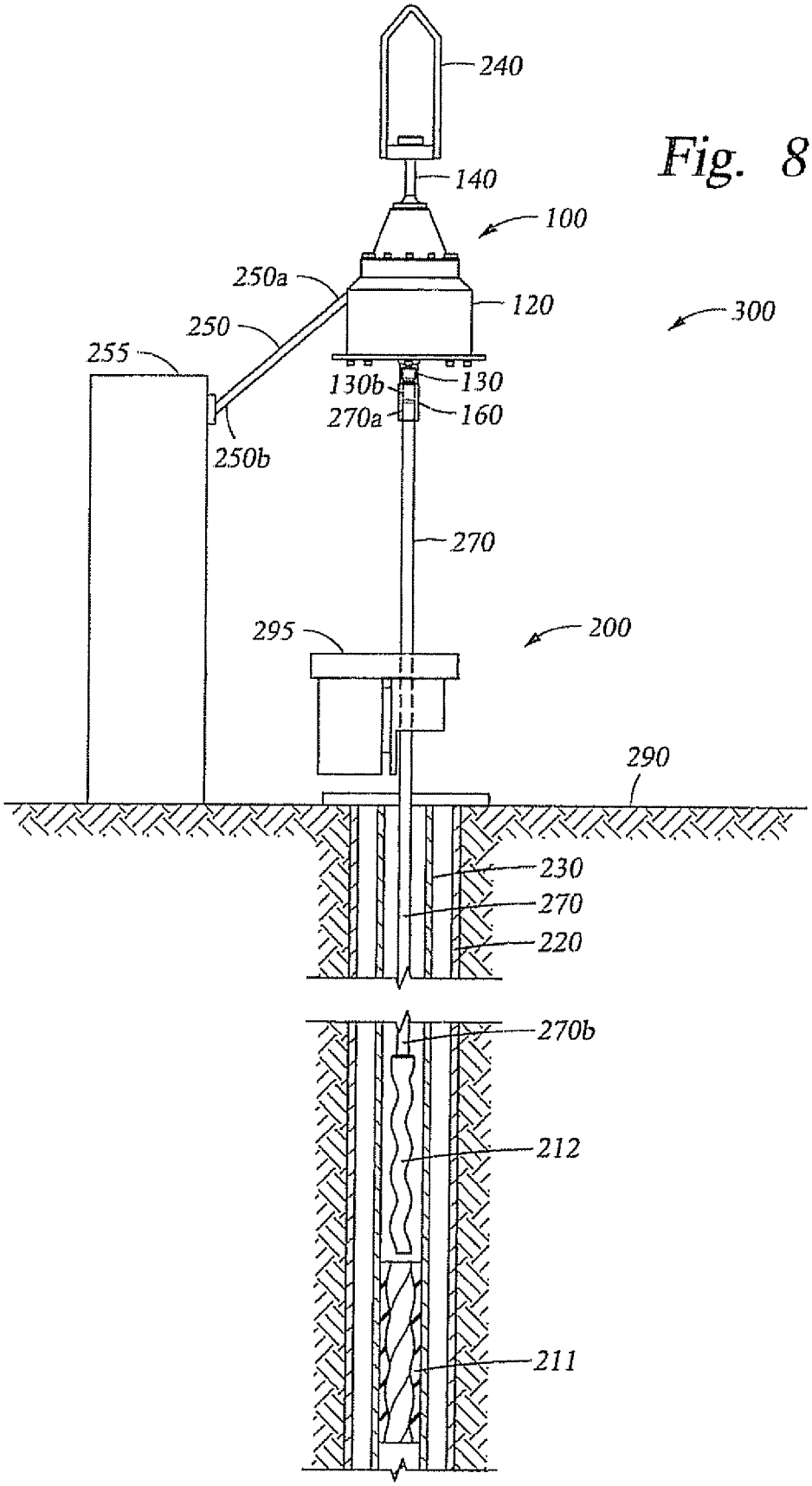

Referring now to FIGS. 7 and 8, a system 300 for simultaneously pulling and retarding the backspin of rotor 212 and rod string 170 is illustrated. System 300 comprises flush-by-brake 100, connector 160, rod string 170, and rotor 212 of progressive cavity pump 210, each as previously described. Upper end 170*a* of rod string 170 is releasably coupled to lower end 130*b* via connector 160 as previously described.

Figure 9:
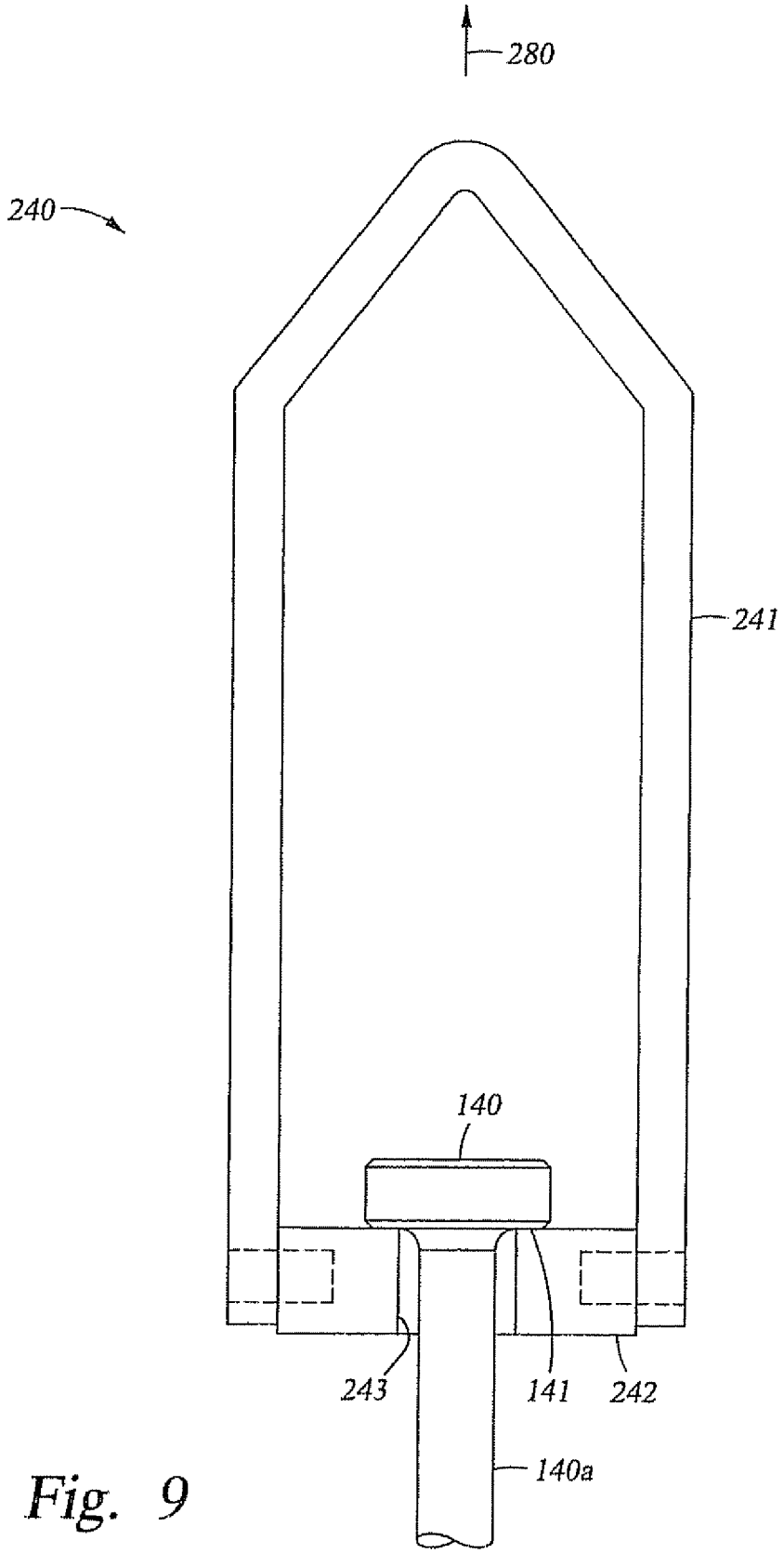
FIG. 9 is an enlarged front view of the lifting device and handle of FIGS. 7 and 8.

System 300 further comprises a lifting device 240 releasably coupled to handle 140. Lifting device 240 is secured to grip portion 140*a* such that axial lifting forces represented by arrow 280 are transferred to housing 120. For instance, referring briefly to FIG. 9, in this embodiment, lifting device 240 comprises a rod elevator that includes a hanger 241 coupled to a base 242 including an open ended slot 243. Grip portion 140*a* of handle 140 is slidingly disposed within slot 243. The width of slot 243 is sufficient to permit reduced diameter portion 141 to slide therein, but smaller than the width of upper annular shoulder 141. Thus, once grip portion 140*a* is disposed within slot 243, upper annular shoulder 141 engages and is supported by the upper surface of base 242 immediately adjacent slot 243. In this manner, lifting device 240 is configured to exert an axial lifting force in the direction of arrow 280 against the upper annular shoulder 141.

Lifting forces generally in the direction of arrow 280 may be applied by any suitable means including, without limitation, a crane, a pulley-system, a flush-by-truck, a jack, or combinations thereof. The lifting forces are transferred through lifting device 240, handle 140, housing 120, shaft 130, connector 160 and rod string 170 to rotor 212. When a sufficient lifting force is applied, rotor 212 is completely pulled from stator 211 as best shown in FIG. 8. The lifting force applied is preferably sufficient to lift rotor 212 from stator 211, and further, lifting device 240 and flush-by-brake 100 are preferably configured and constructed with sufficient strength to withstand the applied lifting forces. It should be appreciated that depending on the application, the lifting forces necessary to lift rotor 212 may vary. For instance, the lifting forces required to lift rotor 212 may exceed 30,000 lbs or even 50,000 lbs.

As previously described, housing 120 may have a tendency to rotate with shaft 130 as shaft 130 begins to rotate. However, to enhance the retarding forces applied to shaft 130, housing 120 is preferably restricted from rotating along with shaft 130. Thus, in this embodiment, an anchor 250 is provided. Anchor 250 includes a first end 250*a* releasably coupled to housing 120 and a second end 250*b* coupled to a rigid non-moveable object 255 proximal flush-by-brake 100. For instance, the second end 250*b* of anchor 250 may be connected to an adjacent rig, flush-by truck, or a crane. Anchor 250 preferably has sufficient strength to withstanding tensile forces exerted by housing 120 as it attempts to rotate with shaft 130. For instance, anchor 250 may comprise a cable (e.g., a winch cable), a chain, a rope, or the like.

As housing 120 seeks to rotate with shaft 130, it will tug or pull first end 250*a*. However, anchor 250 having its second end 250*b* secured to object 250 and being able to withstand tensile forces restricts housing 120 and stator 152 from rotating with shaft 130 and rotor 154. It should be appreciated that as housing 120 is axially lifted, the location of first end 250*a* will move axially relative to the location of second end 250*b*. The length of anchor 250 is preferably sufficient such housing 120 may be lifted sufficiently to completely pull rotor 212 from stator 211. For instance, prior to lifting housing 120, anchor 250 may include some slack sufficient to account for the distance that housing 120 is lifted relative to object 255.

Referring still to FIG. 8, as rotor 212 is pulled from stator 211, rotor 212 and rod string 170 will have a tendency to backspin as previously described. The rotation or backspin of rotor 212 and rod string 170 is transferred to shaft 130 via connector 160. Bearings 125*a, b* permit shaft 130 to rotate along with rod string 170 relative to housing 120, however, as shaft 130 rotates relative to housing 120, brake 150 provides retarding forces that generally oppose the rotation of shaft 130.

As best shown in FIG. 6, during normal pumping operations, drivehead 295 drives the rotation of rotor 212 via rod string 270, thereby powering downhole progressive cavity pump 210. In particular, drivehead 295 is coupled to upper end 270*a* of rod string 270 and rotor 212 is coupled to lower end 270*b* of rod string 270. The rotation of upper end 270*a* by drivehead 295 is translated along the length of rod string 270 to rotor 212. However, on occasion, rotor 212 may become stuck or jammed relative to stator 211, potentially stalling drivehead 295.

In the event rotor 212 gets stuck or jammed, it may be freed by lifting it from stator 212. For example, referring now to FIG. 10, an embodiment of a method 400 for employing system 300 previously described to free a stuck rotor is graphically shown. Moving to block 401, prior to employing system 300, drivehead 295 is preferably shut down (if it has not already stalled out). Next, flush-by-brake 100 is also coupled to lifting device 240 and positioned adjacent upper end 270*a* of rod string 270 according to block 402. More specifically, lifting device 240 is coupled to handle 140 as previously described. With lifting device 240 secured to grip portion 140*a*, axial and radial forces may be applied to housing 120 to move it into position.

Moving to block 403, to restrict housing 120 from rotating along with shaft 130, housing 120 is anchored to fixed, rigid object 255 with anchor 250. Next, flush-by-brake 100 is coupled to rod string 270 according to block 404. In particular, upper end 170*a* of rod string 170 is coupled to lower end 130*b* of shaft 130 via connector 160 as previously described. The longitudinal axes of rod string 270 and shaft 130 are substantially aligned.

Rod string 170 is preferably lifted without damaging drivehead 295 and without damaging any of the mechanical couplings (e.g., mating gears) between drivehead 295 and rod string 170. Depending on the means by which drivehead 295 is coupled to rod string 170, drivehead 295 and rod string 170 may or may not need to be decoupled or disengaged before lifting rod string 170. In some drivehead designs, the rod string (e.g., rod string 170) may be lifted and pulled through the drivehead (e.g., drivehead 295) without damage to the drivehead. In such designs, the rod string may be lifted without disengaging the drivehead and rod string. However, in other drivehead designs, the coupling between the rod string (e.g., rod string 170) and the drivehead (e.g., drivehead 295) may be such that the coupling between the drivehead and rod string must be disengaged in order to prevent damage to the drivehead when the rod string is lifted. In these drivehead designs, the rod string is preferably lifted only after is has been sufficiently de-coupled from the drivehead. Still further, in some cases, the entire drivehead may be completely removed and separated from the rod string before the rod string is pulled in the manner described. Thus, as required, drivehead 295 is decoupled or disengaged from rod string 270 prior to lifting rotor 212 according to block 405.

Figure 10:
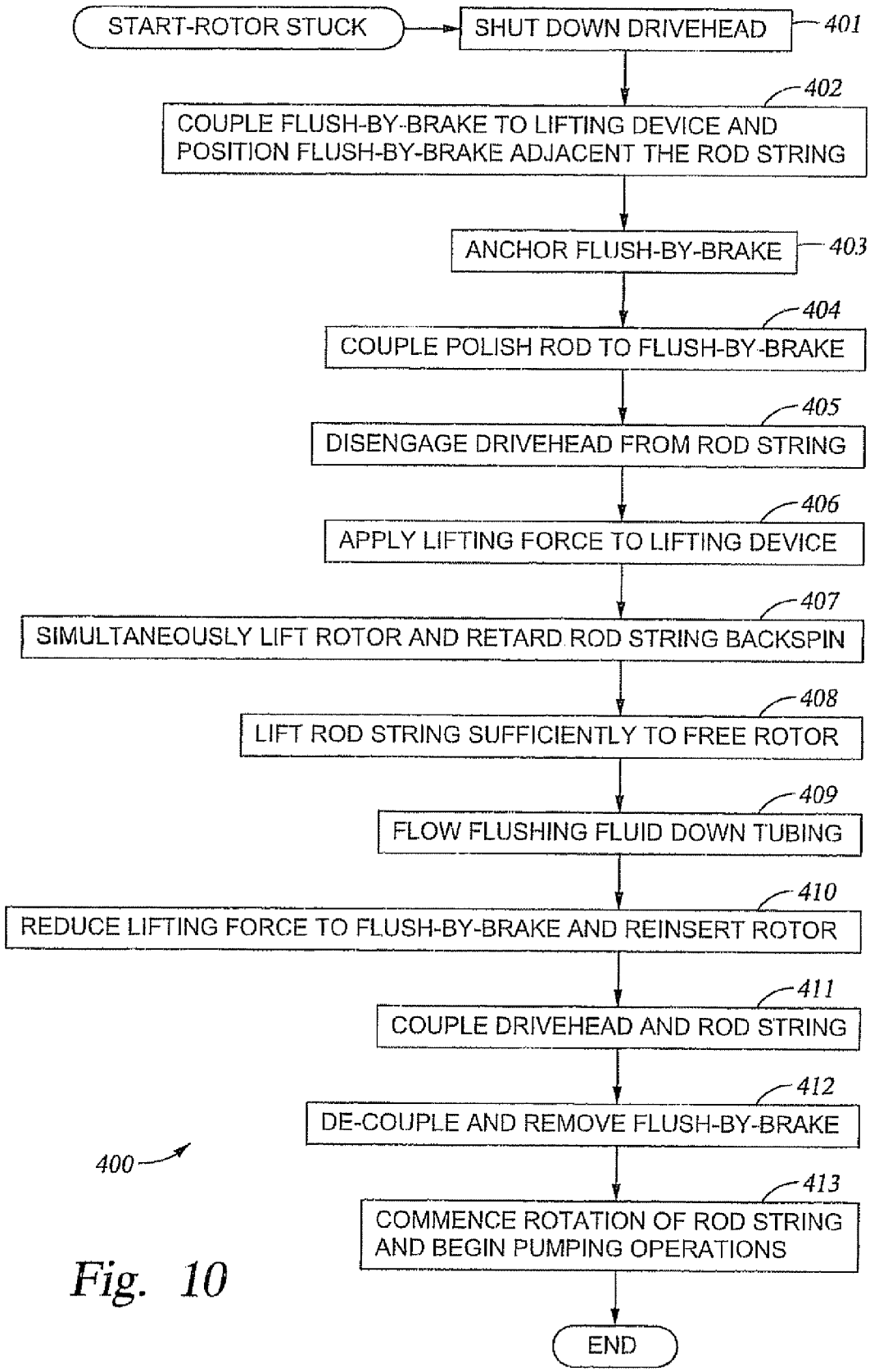
FIG. 10 is a graphical illustration of an embodiment of a method employing the system of FIGS. 7 and 8.

Referring still to FIG. 10, moving to block 406, axial lifting forces represented by arrows 280 (FIG. 7) are applied to lifting device 240, and are transferred to rotor 212 via rod flush-by-brake 100 and rod string 270. With sufficient lifting forces, rotor 212 will be pulled upward relative to stator 211. As rotor 212 is pulled from stator 211, rotor 212 and rod string 170 will have a tendency to backspin. The rotation or backspin of rotor 212 and rod string 170 is transferred to shaft 130 via connector 160. Bearings 125*a, b* permit shaft 130 to rotate along with rod string 170 relative to housing 120, however, as shaft 130 rotates relative to housing 120, brake 150 provides retarding forces that generally oppose the rotation of shaft 130. In this manner, system 300 is configured to simultaneously provide axial lifting forces and retard backspin of rod string 270 as shown in block 407. The axial lifting forces applied to rod string 270 are preferably sufficient to completely lift and free rotor 212 relative to stator 211 according to block 408. According to block 409, after rotor 212 is freed, a flushing fluid (e.g., water) is flowed down tubing 230 to flush away any debris (e.g., sand) that may have caused rotor 212 to jam or that could cause a jam in the future.

Moving to block 410, lifting forces applied to lifting device 240 may be reduced, thereby allowing rotor 212 to be reinserted into stator 211. With rotor 212 sufficiently repositioned in stator 211, drivehead 295 may be coupled to rod string 270, followed by de-coupling and removal of flush-by-brake 100 from upper end 270*a* of rod string 270 according to blocks 411, 412, respectively. Moving now to block 413, drivehead 295 may be started up and pumping operations with progressive cavity pump 210 may be recommenced.

In the manner described, embodiments described herein offer to retard the backspin of a rod string coupled to a downhole rotor when the rotor is pulled from its mating stator. By retarding rod string backspin, the safety of such operations may be enhanced.

While preferred embodiments have been shown and described, modifications thereof can be made by one skilled in the art without departing from the scope or teachings herein. The embodiments described herein are exemplary only and are not limiting. Many variations and modifications of the system and apparatus are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims.

What is claimed is:

1. A system for retarding the backspin of a rod string, comprising:

a progressive cavity pump including a helical rotor disposed within a mating stator;

a rod string having a longitudinal axis, a first end, and a second end coupled to the rotor;

a rotation retarding device coupled to the first end of the rod string, wherein the rotation retarding device is configured to retard the rotation of the rod string relative to the stator, the rotation retarding device comprising;

a housing having an upper end, a lower end, and a brake cavity;

a shaft at least partially disposed in the brake cavity, wherein the shaft is rotatably coupled to the housing; and a hydrodynamic brake disposed in the brake cavity, wherein the hydrodynamic brake is configured to retard the rotation of the shaft relative to the housing; and a lifting device coupled to the rotation retarding device, wherein the lifting device is configured to apply an axial lifting force to the rotation retarding device and the rotor.

2. The system of claim 1 wherein the lower end of the housing includes a through bore and wherein the shaft extends through the bore.

3. The system of claim 1 further comprising an anchor coupled to the housing, wherein the anchor restricts the rotation of the housing relative to the stator.

4. The system of claim 3 wherein the anchor includes a first end coupled to the housing and a second end coupled to a substantially rigid fixed object.

5. The system of claim 1 wherein the hydrodynamic brake comprises an annular stator fixed to the housing and an annular rotor fixed to the shaft, wherein the stator and the rotor are disposed about the shaft axially adjacent each other.

6. The system of claim 5 wherein the housing comprises:

a top, a cylindrical body, and a cap including the through bore;

wherein the top and the body define the bearing cavity;

wherein the body and cap define the brake cavity; and wherein the top and the cap are releasably coupled to the body.

7. The system of claim 1 wherein the housing comprises a handle extending axially from its upper end, and wherein the lifting device is releasably coupled to the handle.

8. The system of claim 7 wherein the lifting device comprises a rod elevator.

9. The system of claim 1, wherein the housing further comprises a bearing cavity and a bearing assembly disposed in the bearing cavity between the shaft and the housing, the bearing assembly rotatably supporting the shaft.

10. A system for retarding the backspin of a rod string, comprising:

a progressive cavity pump including a helical rotor disposed within a mating stator;

a rod string having a longitudinal axis, a first end, and a second end coupled to the rotor;

a rotation retarding device coupled to the first end of the rod string, wherein the rotation retarding device is configured to retard the rotation of the rod string relative to the stator; and a lifting device coupled to the rotation retarding device, wherein the lifting device is configured to apply an axial lifting force to the rotation retarding device and the rotor;

wherein the rotation retarding device comprises:

a housing having an upper end, a lower end, a brake cavity, a bearing cavity, and a bearing assembly disposed in the bearing cavity between the shaft and the housing, the bearing assembly rotatably supporting the shaft;

a shaft at least partially disposed in the brake cavity, wherein the shaft is rotatably coupled to the housing; and a brake disposed in the brake cavity, wherein the brake is configured to retard the rotation of the shaft relative to the housing.

11. The system of claim 10, wherein the lower end of the housing includes a through bore and wherein the shaft extends through the bore.

12. The system of claim 10, further comprising an anchor coupled to the housing, wherein the anchor restricts the rotation of the housing relative to the stator.

13. The system of claim 12, wherein the anchor includes a first end coupled to the housing and a second end coupled to a substantially rigid fixed object.

14. The system of claim 10, wherein the brake comprises a hydrodynamic brake.

15. The system of claim 14, wherein the hydrodynamic brake comprises an annular stator fixed to the housing and an annular rotor fixed to the shaft, wherein the stator and the rotor are disposed about the shaft axially adjacent each other.

16. The system of claim 15 wherein the housing comprises:

a top, a cylindrical body, and a cap including the through bore;

wherein the top and the body define the bearing cavity;

wherein the body and cap define the brake cavity; and wherein the top and the cap are releasably coupled to the body.

17. The system of claim 10, wherein the housing comprises a handle extending axially from its upper end, and wherein the lifting device is releasably coupled to the handle.

18. The system of claim 17, wherein the lifting device comprises a rod elevator.

19. A system for retarding the backspin of a rod string, comprising:

a housing having an upper end, a lower end, and a brake cavity;

a shaft having a longitudinal axis at least partially disposed in the brake cavity, wherein the shaft is rotatably coupled to the housing and is configured to rotate about its axis relative to the housing;

a hydrodynamic brake disposed in the brake cavity, wherein the hydrodynamic brake is configured to retard the rotation of the shaft relative to the housing;

a rod string having a first end and a second end, wherein the first end of the rod string is coupled to the shaft;

a progressive cavity pump including a helical rotor disposed within a mating stator, the rotor coupled to the second end of the rod string; and a lifting device coupled to the housing, wherein the lifting device is configured to apply an axial lifting force to the housing and the rod string.

20. The system of claim 19 further comprising an anchor coupled to the housing, wherein the anchor restricts the rotation of the housing relative to the shaft.

21. The system of claim 20 wherein the anchor includes a first end coupled to the housing and a second end coupled to a substantially rigid fixed object proximal the housing.

* * * * *